United States Patent [19]

Drew

[11] Patent Number: 4,762,598

[45] Date of Patent: Aug. 9, 1988

[54] ELECTROLYTIC METAL RECOVERY

[76] Inventor: Peter R. Drew, 7 Peter Place, Melton, Australia, 3337

[21] Appl. No.: 12,001

[22] PCT Filed: May 15, 1986

[86] PCT No.: PCT/AU86/00138

§ 371 Date: Jan. 12, 1987

§ 102(e) Date: Jan. 12, 1987

[87] PCT Pub. No.: WO86/06761

PCT Pub. Date: Nov. 20, 1986

[30] Foreign Application Priority Data

May 15, 1985 [AU] Australia ..... PH0573

[51] Int. Cl.[4] ..... C25C 1/20

[52] U.S. Cl. ..... 204/109; 204/228

[58] Field of Search ..... 204/109–111, 204/228

[56] References Cited

PUBLICATIONS

Electroplating Eng. Handbook, by A. K. Graham, Reinhold, 1955, pp. 554–555.

*Primary Examiner*—R. L. Andrews

*Attorney, Agent, or Firm*—Sughrue, Mion, Zinn, Macpeak & Seas

[57] ABSTRACT

Electrolytic recovery of silver metal is accomplished by application of a direct current with controlled ripple such that for any concentration of silver in the electrolyte, the instantaneous magnitude of the electrical potential across the electrodes is sufficient to sustain deposition of silver on the cathode while the peak values of said electrical potential are below the critical potential at and above which silver sulphide is precipitated from solution and/or hydrogen sulphide gas is generated.

8 Claims, 1 Drawing Sheet

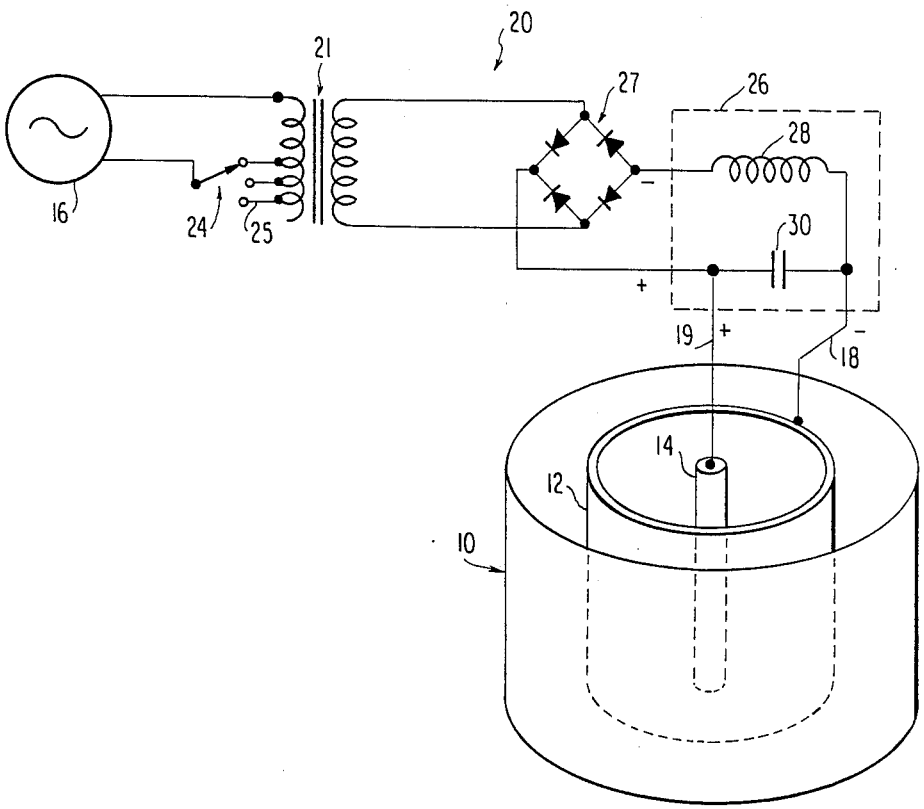
20
21
27
26
28
30
16
24
25
+
19
+
18
14
12
10

ELECTROLYTIC METAL RECOVERY

TECHNICAL FIELD

This invention relates to the electrolytic recovery of metal from solutions containing the metal and has particular but by no means exclusive application to the recovery of silver from waste photographic solutions.

BACKGROUND ART

Electrolytic techniques for recovering silver from waste photographic solutions such as waste fixer have gained favour in recent years. The silver is generally deposited as plate on the cathode, which is periodically removed from the solution for stripping of the silver. Commercial electrolytic recovery equipment abounds but to date recovery of 95% of the available silver has been considered excellent. In practice, the recovery of even 70% is difficult to maintain, let alone exceed.

The principal problem which has arisen in electrolytic recovery of silver from waste photographic solutions has been the precipitation of silver sulphide when the silver concentration, which is typically of the order of 4 gm/l in the untreated solution, falls below 0.5 gm/l. The precipitation of silver sulphide produces a contaminated product and prevents further silver plating, and may be accompanied by the generation of undesirable hydrogen sulphide gas.

It has been recognized that the formation of silver sulphide is associated with an increase in the potential across the electrodes of the electrolyte cell. It has been further appreciated that there is a critical potential across the electrodes at which sulphide formation will commence. These limits are more critical at low silver concentrations, e.g. below 0.5 gm/l. The general approach in the past has therefore been to carefully control the applied current at low silver concentrations. Since the magnitude of the current determines the rate of removal of silver from solution and since setting the current too low will result in commercially unacceptably long recovery times, know electrolytic systems have relied on current settings which were a compromise between speed and efficiency of silver recovery. Moreover, this equipment has entailed careful control of the silver concentration/current density relationship to minimize sulphiding and has therefore required sophisticated sensing devices and feed-back circuits which in many cases have been expensive yet unreliable or ineffective.

Another known approach has been to attempt to maintain an essentially constant flow of solution through the cell while maintaining an essentially constant current density at a level appropriate for the approximate expected average silver concentration. The very nature of these flowthrough cells determines that during operation silver losses occur due to displacement of solution in the cell by input solution from the metering pump. Furthermore, if input silver concentration varies substantially such systems are unable to provide efficient recovery: when the input silver concentration is high, substantial quantities of silver pass through without being recovered, but when the silver concentration is too low, sulphiding occurs.

It is therefore an object of the invention to provide method and apparatus for the electrolytic recovery of metal from solutions which, when applied to the recovery of silver from waste photographic solutions, are able to provide an enhanced silver recovery substantially without sulphiding side reactions.

DISCLOSURE OF INVENTION

The invention is based upon the realization that many of the prior techniques for carefully controlling the magnitue of the applied current to the electrodes of the electrolytic cell were wholly failing to appreciate the importance of the ripple which was inevitably superimposed upon the applied current where it was derived from an AC power source. It is considered by the present applicant that this ripple is typically of the order of ±15% in existing commercial silver recovery equipment and in some cases is considerably higher. Where the instantaneous value of the current exceeds the critical potential for silver sulphide precipitation even momentarily, sulphide precipitation occurs. Because silver sulphide is extremely insoluble, this reaction is substantially irreversible. It will be appreciated that a periodic upward variation of the applied current by 15% is a very substantial at very low silver concentrations, at which it is believed that the margins between the minimum potential to sustain deposits of silver on the cathode (the "half-wave potential" for silver in the system) and the aforementioned critical potential is quite small. In the more general case, the peaks in the ripple cause losses of electrical energy to other cathodic reactions which have been traditionally accepted as inevitable.

The invention broadly provides a method of electrolytically recovering metal from a solution containing the metal, comprising contacting the solution with a pair of electrodes and applying a direct electrical current derived from an AC power source across the electrodes and thereby through the solution to cause the metal to be deposited at that electrode which is the cathode, characterized in that the ripple of the applied direct current is controlled so that, for any concentration of the metal, the instantaneous magnitude of the electrical potential across the electrodes is sufficient to sustain deposit of the metal on the cathode while the peak values of said electric potential are sufficiently low for losses of electrical energy to cathodic reactions other than the said deposit of metal to be less than a predetermined proportion of the available electrical energy provided by the applied direct current.

More particularly the invention provides a method of electrolytically recovering metal from a solution containing the metal, comprising contacting the solution with a pair of electrodes and applying a direct electrical current derived from an AC power source across the electrodes and thereby through the solution to cause the metal to be deposited at that electrode which is the cathode, characterized in that the ripple of the applied direct current is controlled so that, for any concentration of the metal, the instanteous magnitude of the electrical potential across the electrodes is sufficient to sustain deposit of the metal on the cathode but below the critical potential at and above which the metal precipitates as a compound with other ions in the solution and/or at and above which there commences any cathodic reaction other than said deposit of the metal.

In a particularly advantageous application, the metal being recovered is silver, the solution is a waste photographic solution containing silver, and the critical potential is that at or above which silver sulphide is precipitated from the solution and/or hydrogen sulphide gas is generated from the solution.

A feature of prior art silver recovery systems is that the applied value of the direct current is stepped down by feed-back control loops, on the one hand to maximize the rate of silver recovery at higher silver concentrations while on the other to keep the electrode potential below the aforesaid critical value at lower concentrations. In accordance with a preferred aspect of the invention, the applied direct current is maintained at a substantially constant mean value for the duration of the recovery of silver from a given batch of solution, this constant value being selected with regard to the aforesaid ripple so that, for any concentration of the metal, the instantaneous magnitude of the electrical potential across the electrodes is sufficient to sustain deposit of the metal on the cathode but below the critical potential at and above which the metal precipitates as a compound from the solution and/or at and above which there commences any cathodic reaction other than said deposit of the metal.

Also afforded by the invention is apparatus for electrolytically recovering metal from a solution containing the metal, comprising an electrolytic cell having a pair of electrodes for holding the solution in contact with the electrodes, and means to apply a direct electrical current derived from an AC power source across the electrodes and thereby through the solution to cause the metal to be deposited at that electrode which forms the cathode, characterized by means to control the ripple of the applied direct current so that, for any concentration of the metal, the instantaneous magnitude of the electrical potential across the electrodes is sufficient to sustain deposit of the metal on the cathode while the peak values of said electric potential are sufficiently low for losses of electrical energy to cathodic reactions other than the said deposit of metal to be less than a predetermined proportion of the available electrical energy provided by the applied direct current.

The invention still further extends to apparatus for electrolytically recovering metal from a solution containing the metal, comprising an electrolytic cell having a pair of electrodes for holding the solution in contact with the electrodes, and means to apply direct electrical current derived from an AC power source across the electrodes and thereby through the solution to cause the metal to be deposited at that electrode which is the cathode, characterized by means to control the ripple of the applied direct current so that, for any concentration of the metal, the instantaneous magnitude of the electrical potential across the electrodes is sufficient to sustain deposit of the metal on the cathode but below the critical potential at and above which the metal precipitates as a compound with other ions in the solution and/or at and above which there commences any cathodic reaction other than said deposit of the metal.

For application of the apparatus to the recovery of silver from waste photographic fixer, the aforesaid control means is adapted so that the ripple of the applied current is equal to or less than ±6%, for bleach fix 8%.

It will be appreciated from the earlier discussion that the apparatus may be of an entirely conventional form save that the power supply component includes a filter element capable of achieving reduction of the ripple of the applied current to a proportional amplitude well below that of conventional equipment. This power supply may thus include conventional AC to DC rectifier means and capacitance means chosen to control the ripple of the rectifier output in accordance with the invention.

It will be understood that the precise mean values of the applied current and the permissible AC ripple will be dependent on the interaction of several parameters of each electrolytic recovery system, e.g. the precise nature of the solution, the electrode reactions involved, the degree of agitation of the solution, and the physical characteristics of the electrolytic cell. In each case, the derivation of the most favourable mean DC value of the applied current and the maximum permissible ripple will be a matter for empirical determination. In the general case, the precise values will be determined by the predetermined current efficiency desired of the system.

MODES FOR CARRYING OUT THE INVENTION

The attached drawing is a simplified schematic diagram of apparatus in accordance with the invention showing detail of the electrolytic cell power supply.

The apparatus includes an electrolytic cell 10 having a stainless steel annular cathode 12 and a carbon graphite solid cyclindrical anode 14. These electrodes 12, 14 are removable, the cathode in particular for stripping the silver which plates on the cathode during operation of the unit. A direct electrical current derived from the AC mains 16 is applied to electrodes 12, 14 via electrical leads 18, 19 by power supply 20. The principal components of power supply 20 are an AC stepdown transformer 21, an AC to DC full-wave rectifier 22 of conventional construction, a controller 24 for manually setting the mean DC value of the applied current in accordance with the nature of the solution to be treated, and filter means 26 for controlling the ripple of the applied current within maximum limits in accordance with the invention. Controller 24 is a switch selectively engageable with multiple primary taps 25 on transformer 21.

Filter means 26 comprises a choke inductance 28, for example of 6 mH, in series with the rectifier, and in parallel, a high value capacitance 30, for example of $10^4$ microfarad. This filter arrangement will typically control the ripple of the applied current to about ±5%.

EXAMPLE 1

Apparatus in accordance with the illustrated configuration was employed to recover silver from batches of waste photographic fixer. The fixer processed has an initial silver concentration of 3.69 gm/l. It was found that the half-wave potential for silver in this fixer was about 0.8 volts, a typical value. The mean DC value of the applied current was initially set at 3.5 amps, resulting in a cell potential, i.e. a potential across the electrodes 14, 16, of about 1.2 volts. The precise current characteristic was observed with a cathode ray oscilloscope and the ripple of the applied current found to be ±5%.

Cell 20 was flushed with water and drained, cathode 12 was washed, dried and weighed and the cell reassembled. The fixer was introduced into the cell to the appropriate level and the current applied for a preset time of 390 minutes during which regular samples of the cell solution were taken for analysis. At the end of this time, the cell was emptied as effluent and the weight of the silver plated cathode taken. The results are set out in Table 1.

TABLE 1

| Time (min.) | Current (amps) | voltage | Silver Conc. (g/l) |
|---|---|---|---|
| 0 | 0 | — | 3.69 |
| 38 | 3.3 | 1.204 | 3.21 |
| 121 | 3.15 | 1.208 | 2.07 |
| 177 | 3.75 | 1.222 | 1.37 |
| 261 | 3.3 | 1.249 | 0.102 |
| 335 | 3.1 | 1.257 | 0.00015 |
| 380 | 3.2 | 1.267 | 0.0001 |
| 391 (effluent) | 0 | | 0.0027 |
| Recovery efficiency | | 99.8% | |
| Current efficiency | | 97% | |

During the whole of this time, there was no evidence whatever of silver sulphide precipitation from the solution or of generation of hydrogen sulphide gas.

EXAMPLE 2

Apparatus slightly modified from that illustrated was employed to recover silver from batches of photographic bleach-fix/fixer mixture. As a higher current is required for this electrolysis, inductance 28 was not included and the value of capacitance 30 increased. The half-wave potential for silver in the bleach-fix was found to be again about 0.8 volts. Initial silver concentration was about 6.6 gm/l, the mean DC value of the applied current about °amps. The ripple of the applied current was observed to be ±6%. The method was generally similar to Example 1 and the results are set out in Table 2.

TABLE 2

| Time (min.) | Current (amps) | voltage | Silver Conc. (g/l) |
|---|---|---|---|
| 0 | 19 | 2.34 | 6.60 |
| 30 | 20 | 2.27 | 6.00 |
| 60 | 20 | 2.25 | 5.30 |
| 120 | 20 | 2.31 | 3.70 |
| 180 | 20 | 2.33 | 2.15 |
| 240 | 20 | 2.36 | 0.850 |
| 300 | 20 | 2.41 | 0.210 |
| 360 | 20 | 2.46 | 0.011 |
| 400 | 20 | 2.48 | 0.003 |
| Recovery efficiency | | 99.9% | |
| Current efficiency | | 97% | |

During the whole of this time, there was no evidence whatever of silver sulphide precipitation from the solution or of generation of hydrogen sulphide gas.

It will be appreciated from the above examples that the method and apparatus of the invention is capable of recovering a very high proportion of the available silver from waste photographic solutions and of reducing the silver concentration in the solution to an extremely low level. The technique and equipment are notable for their simplicity and there is no reliance on sophisticated feed-back and current control electronics. The recovery proceeds essentially to finality at a relatively repid rate without the occurrence of unwanted side reactions such as precipitation of silver sulphide or generation of hydrogen sulphide. The excellent recovery efficiency confirms the absence of losses to such side reactions.

Another feature of the above examples is the high current efficiency achieved. This expresses the proportion of the available electrical energy actually utilized in the conversion of silver ions to deposited silver. The high value of the current efficiency, compared with the 90% or so typical of prior units, is a further indication of the success of the invention in avoiding unwanted cathodic side reactions.

EXAMPLE 3

To test the application of the invention to the recovery of gold from alkaline cyanide solutions, in which hydrogen gas evolution is an important cathodic side reaction which is desirably avoided or at least minimized, 6.08 g of gold was dissolved in aqua regia and the resultant solution neutralized and used to make up a solution containing 1% NaOH and 0.2% NaCN. Utilizing the configuration in the drawing, this solution was subjected to electrolysis for 390 minutes. The mean DC value of the applied current was initially 2 amps. The ripple of the applied current was ±5%.

The results are set out in Table 3.

TABLE 3

| Time (min.) | Current (amps) | voltage | Gold Conc. (ppm) |
|---|---|---|---|
| 0 | 2.00 | 2.629 | 293 |
| 31 | 2.06 | 2.644 | 224 |
| 60 | 2.09 | 2.653 | 144 |
| 90 | 2.04 | 2.619 | 109 |
| 120 | 2.07 | 2.602 | 70 |
| 180 | 2.20 | 2.560 | 23.7 |
| 300 | 2.08 | 2.420 | 3.3 |
| 365 | 1.77 | 2.121 | 1.5 |
| 390 | 1.70 | 2.123 | 1.2 |
| Recovery efficiency | | 99.6% | |
| Current efficiency | | 25% | |

EXAMPLE 4

Potassium aurocyanide was employed as a source of gold for a prepared electrolyte solution containing 1% NaOH, 0.2% NaCH and $KAu(CN)_2$, providing a gold concentration of 0.0327 g/l. The ripple of the applied current was ±5% and its mean DC value about 2 amps. The result are shown in Table 4.

TABLE 4

| Time (min.) | Current (amps) | Voltage | Gold Conc. (ppm) |
|---|---|---|---|
| 0 | — | — | 300 |
| 20 | 1.94 | 2.461 | 273 |
| 40 | 1.93 | 2.444 | 215 |
| 60 | 1.99 | 2.424 | 167 |
| 80 | 2.02 | 2.423 | 122 |
| 100 | 2.02 | 2.137 | 88 |
| 189 | 1.97 | 2.153 | 18 |
| 240 | 1.97 | 2.160 | 6 |
| 300 | 1.89 | 2.138 | 1.8 |
| 360 | 1.93 | — | 0.7 |
| Recovery efficiency | | 99.8% | |
| Current efficiency | | 25% | |

These latter examples demonstrate the excellent recovery efficiencies obtainable in reasonable time in the electrolytic recovery of gold from alkaline cyanide solutions. This performance confirms reduced losses to other cathodic side reactions, i.e. to reactions other than the deposit of gold.

The calculated current efficiency, estimated for examples 3 and 4 to be about 25%, is a very material improvement on prior electrolytic cyanide processes for gold recovery, in which the typical current efficiency is of the order of 2 to 5%. This result further highlights the reduced loss of electrical energy to cathodic side reactions.

It will of course be understood that this invention is not restricted in its scope to the silver and gold recovery processes exemplified above but extends to any technique in which a metal is recovered electrolytically from a solution.

I claim:

1. A method of electrolytically recovering silver from a solution which contains silver and from which, at lower silver concentrations and above a critical electrical potential, silver sulphide precipitates and/or hydrogen sulphide gas is generated, comprising applying a direct electrical current derived from an AC power source across a pair of electrodes in the solution and thereby through the solution to cause silver to be deposited at that electrode which is the cathode, wherein the ripple of the applied direct current is controlled so that, for any concentration of silver in the solution, the instantaneous magnitude of the electrical potential across the electrodes is sufficient to sustain deposit of silver on the cathode while the peak values of said electric potential are below the critical potential at and above which silver sulphide is precipitated from the solution and/or hydrogen sulphide gas is generated from the solution.

2. A method according to claim 1 further characterized in that the metal being recovered is silver, wherein the solution is a waste photographic solution containing silver.

3. A method according to claim 2 wherein said solution is waste photographic fixer and said ripple of the applied direct current is less than or equal to ±6%.

4. A method according to claim 3 wherein the mean value of said applied direct current is between 2 and 5 amps.

5. A method according to claim 2 wherein said solution is waste photographic bleach-fix and said ripple of the applied direct current is controlled to less than or equal to ±8%.

6. A method according to claim 5 wherein the mean value of said applied direct current is between 15 and 25 amps.

7. Apparatus for electrolytically recovering silver from a solution which contains silver and from which, at lower silver concentrations and above a critical electrical potential, silver sulphide precipitates and/or hydrogen sulphide gas is generated, comprising an electrolytic cell having a pair of electrodes for holding the solution in contact with the electrodes, and means to apply a direct electrical current derived from an AC power source across the electrodes and thereby through the solution to cause silver to be deposited at that electrode which forms that cathode, wherein the apparatus includes means to control the ripple of the applied direct current so that, for any concentration of silver in the solution, the instantaneous magnitude of the electrical potential across the electrodes is sufficient to sustain deposit of silver on the cathode while the peak values of said electric potential are below the critical potential at and above which silver sulphide is precipitated from the solution and/or hydrogen sulphide gas is generated from the solution.

8. Apparatus according to claim 7 wherein said control means is adapted so that the ripple of the applied direct current is equal to or less than ±6%.

* * * * *